US005913350A

United States Patent [19]

Klüting

[11] Patent Number: 5,913,350

[45] Date of Patent: Jun. 22, 1999

[54] DOOR LOCK FOR A MOTOR VEHICLE DOOR FORMED INTEGRALLY WITH THE DOOR HINGE

[75] Inventor: Bernd-Alfred Klüting, Radevormald, Germany

[73] Assignee: ED. Scharwächter GmbH & Co. KG, Remscheid, Germany

[21] Appl. No.: 09/104,798

[22] Filed: Jun. 25, 1998

[30] Foreign Application Priority Data

Jun. 25, 1997 [DE] Germany ..... 197 27 098

[51] Int. Cl.[6] ..... E05D 11/10

[52] U.S. Cl. ..... 16/334; 16/330; 16/322

[58] Field of Search ..... 16/334, 330, 328, 16/329, 332, 352, 353, 312–314, 299, 300, 321, 322

[56] References Cited

U.S. PATENT DOCUMENTS 4,829,633 5/1989 Kassner ..... 16/322

*Primary Examiner*—Chuck Y. Mah

*Attorney, Agent, or Firm*—Anderson, Kill & Olick, P.C.

[57] ABSTRACT

A door lock for a motor vehicle door includes a plurality of braking and locking bodies, a support for supporting the braking and locking bodies, arranged concentrically with respect to a hinge pin axis and connected with the hinge pin for joint rotation therewith, a plurality of axles extending transverse to the hinge pin axis for supporting the braking and locking bodies in the support, a locking device having a running track concentrically arranged with respect to the hinge pin axis and fixedly connected with the one of two hinge halves, a spring supported against the hinge pin and at least partially congruent with the locking device for biasing the support toward the locking device, a radially extending carrier flange arranged opposite the locking device for connecting the support with the hinge pin for joint notation with the hinge pin, and a pressure plate rotatable together with the carrier flange and axially displaceable under a biasing force applied by the spring the support and the pressure plate being arranged on opposite sides of the carrier flange by axially extending elements.

12 Claims, 3 Drawing Sheets

DOOR LOCK FOR A MOTOR VEHICLE DOOR FORMED INTEGRALLY WITH THE DOOR HINGE

BACKGROUND OF THE INVENTION

1. Field of the Invention

The present invention relates to a door lock for a motor vehicle door, which is formed integrally with a detachable door hinge having two hinge halves attached to respective two parts of a door assembly, a door and a door pillar, and connected with a hinge pin for rotation relative to each other with the hinge pin being received in one of the two hinge halves with a running fit and being connected with another of the two hinge halves for joint rotation therewith, with the door lock including a plurality of braking and locking bodies which are formed as rolling bodies, a support for supporting the braking and locking bodies, the support being arranged concentrically with respect to a hinge axis and being connected with the hinge pin for joint rotation therewith, a plurality of axles extending transverse to the hinge pin axis for supporting the braking and locking bodies in the support, a locking device having a plurality of dent markings corresponding to the plurality of braking and locking bodies, the locking device having an at least partially curved running track concentrically arranged with respect to the hinge pin axis and fixedly connected with the one of the two halves, the braking and locking bodies cooperating with the locking device for retaining the motor vehicle door in a predetermined position, and a spring element supported against the hinge pin and at least partially congruent with the locking device for biasing the support toward the locking device.

2. Description of the Prior Art

In door locks of the type described above, there is provided at least one braking and locking body which is formed as a rolling body rotatably supported on an axle extending transverse to the hinge pin axis. The braking and locking body is biased by a loading spring, which is supported at the free end of the hinge pin, into indentations which define detent markings of a running track. The indentations are provided on the end surface of the at least partially curved running track formed on a collar concentrically arranged with respect to the hinge pin axis. Generally, the braking and locking bodies are formed as conical rollers and are supported on a metal support engageable by the loading spring which simultaneously connects the support with the hinge pin for their joint rotation. In this type of a door lock, also the loading spring is connected with the hinge pin by a metallic which is form-lockingly connected with support for the braking and locking bodies by end face toothing.

Such construction of the door lock permits, advantageously, to reduce the door lock dimensions which insures that less mounting space is needed for a hinge-lock assembly and insures a cost-effective manufacturing of the assembly. However, a drawback of this construction consists in that the loading spring which is associated with the support for the braking and locking bodies, is formed of a plate spring pack that applies a biasing force to a central region of the support which surrounds the hinge pin and that has a comparatively large weight. The drawback of the application of the biasing force to the central region of the support consists in that in case of unfavorable tolerance pairs, predetermined locking positions of the door cannot be adequately retained, and/or an insufficient braking and locking force is applied to the door. Furthermore, for such door hinge-door lock assembly a relatively large space is still needed.

Accordingly, an object of the present invention is to provide a door lock of the above-described type in which a predetermined position of the door is reliably retained.

Another object of the present invention is to provide a door lock of the above-described type which can be produced with the smallest possible manufacturing costs.

A further object of the present invention is to provide a door lock of the above-described type which would require less mounting space and which would have an optimal weight.

A still further object of the present invention is to provide a door lock of the above-described type a noiseless operation of which is achieved independent of the tolerances.

SUMMARY OF THE INVENTION

These and other objects of the present invention, which will become apparent hereinafter, are achieved by providing a door lock of the above-described type in which there is provided a radially extending carrier flange arranged opposite the locking device for connecting the support means with the hinge pin for joint rotation with the hinge pin, and a pressure plate rotatable together with the carrier flange and axially displaceable under an action of a biasing force applied by the spring means for applying the biasing force to the support means. The pressure plate and the support means are arranged on opposite sides of the carrier flange and are connected with means extending parallel to the hinge pin axis. The above-described connection of the support for the braking and locking members with the hinge pin permits to eliminate any deformation of the force-transmitting components, which insures retaining of the door in its predetermined position. Moreover, the foregoing connection of the support with the hinge pin permits to reduce the weight of the assembly. It also permits to reduce the dimensions of the door lock, and thus, the dimensions of the entire door hinge-door lock assembly, which results in that less mounting space for the assembly is required. Still further, the foregoing connection of the support for the braking and rolling bodies to the hinge pin permits to form the locking device from a sheet metal stamped part.

According to a preferred embodiment of the invention, the support for the braking and locking bodies has a U-shaped cross-section, and the pressure plate is provided with peg means which form the means connecting the support with the pressure plate. The pressure plate pegs engage the rear surface of the support. Because a high biasing force is applied to the pressure plate to insure a reliable engagement of the braking and locking bodies with the running track, the pressure plate and the support, even in the absence of a form-locking connection therebetween, are arranged relative to each other so that no relative movement occurs between them, which insures a noiseless operation of the door lock.

To insure a reliable connection of the support with the hinge pin, without the possibility of their rotation relative to each other, advantageously, the support is provided with opening means formed in its base, and the carrier flange has peg means extending into the opening means for connecting the support means with the hinge pin for joint rotation with the hinge pin. A similar construction is used for connecting the pressure plate with the support. Thus, the pressure plate is provided with peg means which extends through opening means formed in the carrier flange and into engagement with the support.

In a particularly simple embodiment of the present invention, both the pressure plate and the carrier flange are formed as sheet metal stamped parts, with the pegs of both the pressure plate and the carrier flange being formed by pulling the sheet material through.

A simple connection of the carrier flange with the hinge pin is obtaining by providing a carrier flange having a collar coaxial with the hinge pin and provided with inner toothing which cooperates with outer axially extending toothed region of the hinge pin for connecting the carrier flange with the hinge pin for joint rotation therewith. In a modified embodiment of the door lock the carrier flange may include a sleeve having an inner toothing for engaging the outer toothing on the hinge pin.

The carrier flange, which is formed as a sheet metal stamped part is, preferably, welded with the separately formed sleeve having an inner toothing.

The use of one or another form of the carrier flange varies from case to case and depends on particular conditions existing during the assembly of the door lock.

According to a modified embodiment of the present invention, the pressure plate is formed as a ring-shaped sheet material section having pegs formed of a solid material and attached to the sheet material section.

In association with the connection of the support with the hinge pin, the support biasing pressure spring is advantageously formed as a helical spring which is connected to the free end of the hinge pin by a spring plate, with the spring plate being connected to the free end of the hinge pin by form-locking connection means, in particular, by a snap ring.

In accordance with a further development of the present invention, the support for the braking and locking body is formed as a U-shaped sheet metal part, and a circumferential ring, which engages an outer circumference of the support outer leg in the region of the axles for retaining the braking and locking bodies in their predetermined position, is provided. For securing the supporting axles in the support, there is provided a ring body which is arranged opposite the inner leg of the support in the region of the axles and which is supported on the hinge pin.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENT

Figure 1:
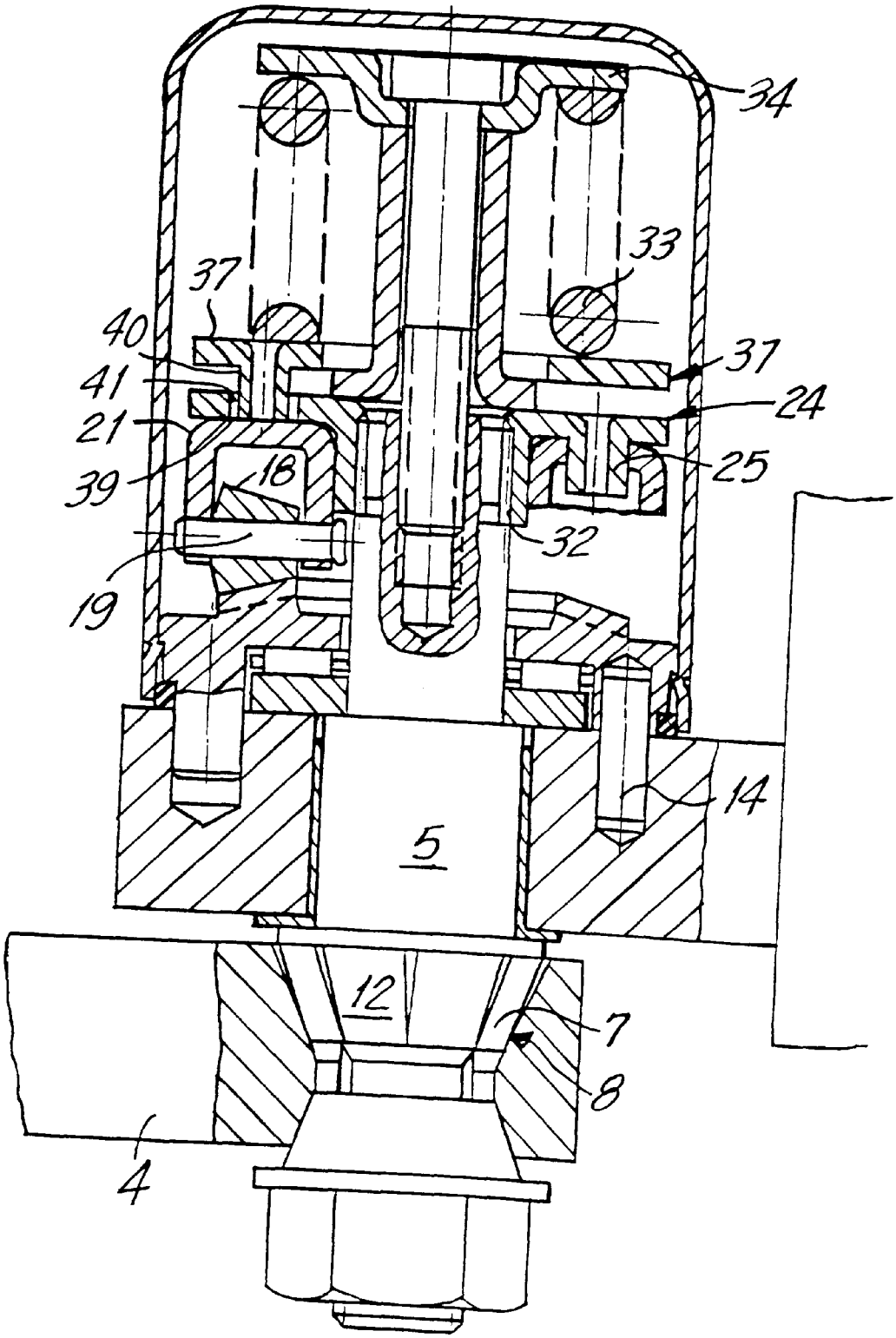
FIG. 1 shows a longitudinal cross-sectional view of a first embodiment of a door lock according to the present invention, which is made integrally with the door hinge.

A separable door hinge, with which a door lock according to the present invention is integrally formed, includes a first hinge half 2 and a second hinge half 4, which are connected, respectively, to first and second parts of a door assembly, not shown in the drawings, and a hinge pin 5 which connects the first and second hinge halves 2 and 4 for their pivotal movement relative to each other. The hinge pin 5 is rotably supported in the first hinge half 2 by a bearing sleeve 6 of a maintenance-free bearing material with a running fit. In the second hinge half 4, the hinge pin 5 is supported in the hinge gadgeon 8 with axially extending, form-lockingly functioning means 7 without a possibility of rotation relative to the gudgeon 8. The hinge pin 5 has a radially extending collar 2 engageable between adjacent end surfaces 9 and 10 of the two hinge halves 2 and 4, respectively. The form-lockingly functioning means 7 is provided at side of the collar 11 adjacent to the detachable hinge half 4. The form-lockingly functioning means 7 includes a cone 12 projecting form the collar 11 and tapering toward the end of the hinge pin 5. The cone 12 cooperates with a corresponding conical bore of the gudgeon 8 to connect the hinge pin 5 with the second hinge half 4 for joint rotation therewith.

The door lock, which is formed integrally with the door hinge, includes a locking device, braking and locking bodies, a support for the braking and locking bodies which is connected with the hinge pin 5, and a spring for biasing the braking and locking bodies.

Figure 2:
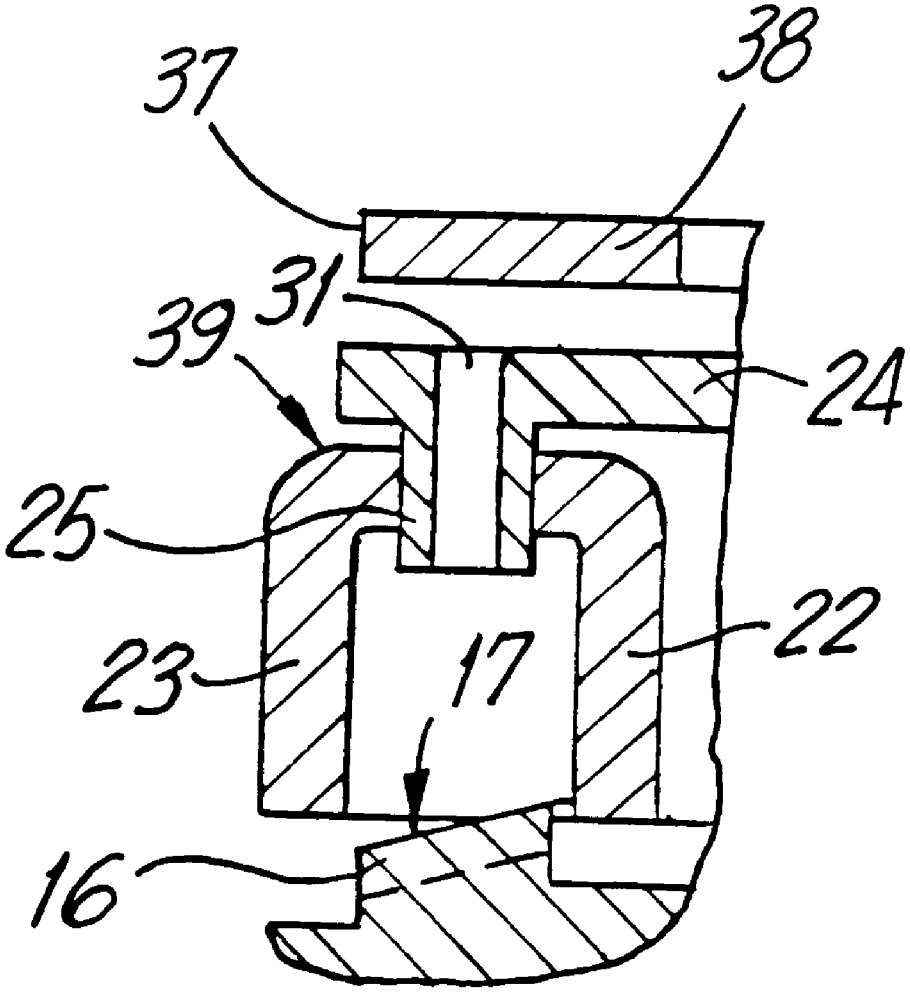
FIG. 2 shows a section of the door lock shown in FIG. 1.
Figure 3:
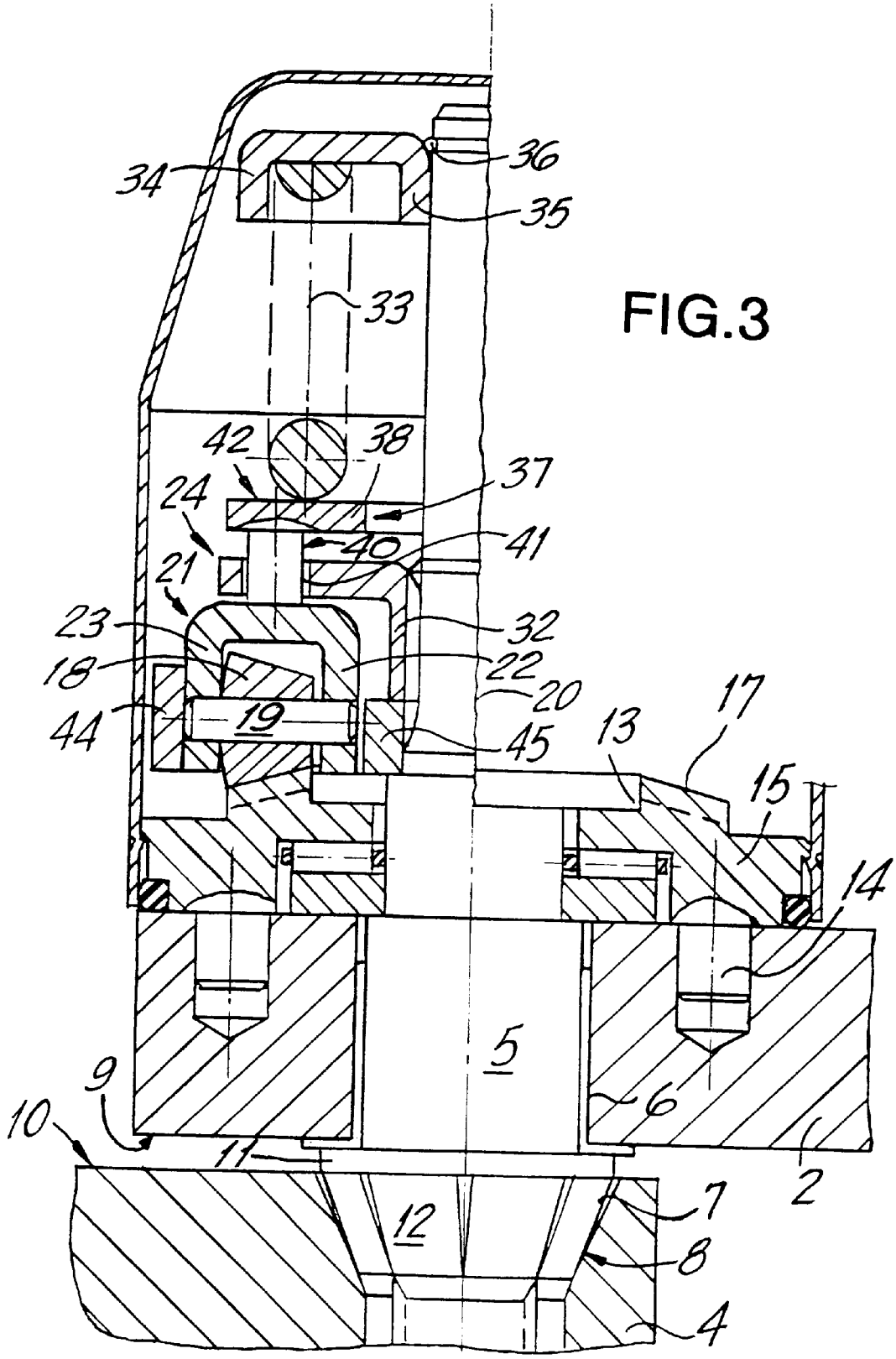
FIG. 3 shows a partial cross-sectional view of a second embodiment of a door lock according to the present invention, which is formed integrally with the door hinge.

In the embodiment of the door lock shown in FIG. 1 the locking device is formed by a running track 17. The running track 17 is arranged on the end surface of a projecting collar 13 of a locking disc 15 which is fixedly connected with the first hinge half 2 by cylindrical pins 14 concentric with respect to the axis of the hinge pin 5. The running track 17, which forms the locking device, is inclined outwardly toward the circumferences of the locking disc 15. The braking and locking bodies 18, which cooperate with the track 17, are formed as conical rollers the shape of which correspond to the inclination of the running track 17. The braking and locking bodies 18 are rotatably supported by respective axles 19, which extend transverse to the hinge axis 12, on a support 21 for the braking and locking bodies 18. The support 21 has an U-shaped cross-section and is formed of a sheet metal stamped part. The braking and locking bodies 18 are rotatably supported by the axles 19, as discussed above, which extend through both legs 22 and 23 of the support 21. The support 21 is connected with the hinge pin 5 for joint rotation therewith by a carrier flange 24 which is fixedly connected to the support 21. The carrier flange 24 (as particularly shown in the right side of FIG. 1 and FIG. 2) has pegs 25, which extend parallel to the hinge pin axis and engage into corresponding openings 26 formed in the base of the support 21. The pegs 25 are formed by pulling through the sheet metal part which forms the carrier flange 24. Thus, the carrier flange 24 is a one-piece part, and it is secured to the hinge pin 5 with an axial collar 32, which is provided in the radially remote, from the hinge pin, flange region of the carrier flange 24 and which cooperates with outer toothing of an elongate section 30 of the hinge pin 5. For application of adequate braking and locking forces by the braking and locking bodies 18, a necessary biasing force is applied to the support 21 by a helical spring 33. The spring 33 is arranged concentrically with the hinge pin 5 and is supported against a free end of the hinge pin 5 by a spring plate 34. The spring plate 34 has a collar 35 and is supported against the hinge pin 5 by a snap ring 36, as shown in FIG. 3. The biasing force of the spring 33 is transmitted to the support 21 by a pressure plate 37 also formed as a sheet metal stamped part. The pressure plate 37 includes pegs 40, which are provided at radial ends 38 of the plate 37 and engage the rear surface 39 of the support 21. The pegs 40 of the pressure plate 37 extend through opening 41 formed in the carrier flange 24. In the embodiment shown in FIG. 1, the pressure plate 37 is formed as a one-piece part, with the pegs 40, which extend parallel to the hinge pin 5, being formed by pulling through the sheet metal part forming the pressure plate 37. The biasing force of the spring 33 is transmitted by the pressure plate 37 and its pegs 40 to the outer surface 39 of the carrier 21.

In the embodiment shown in FIG. 3, the pressure-applying region of the pressure plate 37 is formed by flat sheet metal section from which pegs 40, formed of a solid material, project. The biasing force of the spring 33 is transmitted, as in FIG. 1, by the pressure plate 37 which applies the biasing force to the rear surface of the support 21.

In the embodiment shown in FIG. 3 for securing the braking and locking bodies 18 in the support 21, there are provided a circumferential ring 44, which engages an outer circumference of the leg 23 of the support 21, and a ring 45, which is supported on the hinge pin 5, is provided for securing an axle 19 on the support 21.

Though the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A door lock for a motor vehicle door, which is formed integrally with a detachable door hinge having two hinge halves attached to respective two parts of a door assembly, a door and a door pillar, and connected with a hinge pin for rotation relative to each other, with the hinge pin being received in one of the two hinge halves with a running fit and being connected with another of the two hinge halves for joint rotation therein, the door lock comprising:

a plurality of braking and locking bodies which are formed as rolling bodies;

support means for supporting the braking and locking bodies, the support means being arranged concentrically with respect to a hinge pin axis and being connected with the hinge pin for joint rotation therewith;

a plurality of axles extending transverse to the hinge pin axis for supporting the braking and locking bodies in the support means:

a locking device having a plurality of detent markings corresponding to the plurality of braking and locking bodies, the locking device having an at least partially curved running track concentrically arranged with respect to the hinge pin axis and fixedly connected with the one of the two hinge halves, the braking and locking bodies cooperating with the locking device for retaining the motor vehicle door in a predetermined position; and spring means supported against the hinge pin and at least partially congruent with the locking device for biasing the support means toward the locking device, a radially extending carrier flange arranged on one side of said support means opposite the locking device for connecting the support means with the hinge pin for joint notation with the hinge pin; and a pressure plate rotatable together with the carrier flange and axially displaceable under an action of a biasing force applied by the spring means for applying the biasing force to the support means, the pressure plate and the support means being arranged on opposite sides of the carrier flange and being connected with means extending parallel to the hinge pin axis.

2. A door lock as set forth in claim 1, wherein the support means has U-shaped cross-section, and the pressure plate has peg means, which forms the means connecting the pressure plate and the support means and which engages a rear surface of the support means.

3. A door lock as set forth in claim 2, wherein the support means has opening means formed in a base thereof, and the carrier flange has peg means extending into the opening means for connecting the support means with the hinge pin for joint rotation with the hinge pin.

4. A door lock as set forth in claim 3, wherein the peg means of the pressure plate extends through opening means formed in the carrier flange.

5. A door lock as set forth in claim 4, wherein both the pressure plate and the carrier flange are formed as sheet metal stamped parts,and the pegs of both the pressure plate and the carrier flange are formed by pulling through the sheet metal stamped parts.

6. A door lock as set forth in claim 5, wherein the carrier flange has a collar coaxial with the hinge pin and provided with inner toothing which cooperates with outer axially extending toothed region of the hinge pin for connecting the carrier flange with the hinge pin for joint rotation therewith.

7. A door lock as set forth in claim 5, wherein the carrier flange comprises a sleeve having an inner toothing for engaging outer toothing on the hinge pin.

8. A door lock as set forth in claim 2, wherein the support means is formed as a sheet material part, and the door lock further comprises a circumferential ring engaging an outer circumference of an outer leg of the support means in a region of the supporting axles.

9. A door lock as set forth in claim 8, wherein the axles are secured in the support means with a ring body arranged opposite an inner leg and supported on the hinge pin.

10. A door lock as set forth in claim 1, wherein the pressure plate is formed of a ring-shaped sheet material section and has pegs formed of a solid material projecting from the sheet material section and forming the connecting means.

11. A door lock as set forth in claim 1, wherein the spring means comprises a helical spring and a spring plate for supporting the helical spring at a free end of the hinge pin, and the door lock further comprises form-locking connection means for connecting the spring plate with the hinge pin.

12. A door lock as set forth in claim 11, wherein the form-locking connection means comprises a snap ring.

* * * * *